US006386885B1

(12) United States Patent
Ford

(10) Patent No.: US 6,386,885 B1
(45) Date of Patent: May 14, 2002

(54) DOWNRIGGER CABLE REEL WITH ROTARY ELECTRICAL COUPLING

(75) Inventor: Randolph K. Ford, Stayner (CA)

(73) Assignee: Walker Downriggers, Inc., Stayner (CA)

( * ) Notice: Subject to any disclaimer, the term of this patent is extended or adjusted under 35 U.S.C. 154(b) by 0 days.

(21) Appl. No.: 09/814,651

(22) Filed: Mar. 22, 2001

(51) Int. Cl.[7] ..... H01R 39/00

(52) U.S. Cl. ..... 439/17; 439/21; 439/24; 43/13; 43/11

(58) Field of Search ..... 439/501, 17, 24, 439/22, 23, 13, 15, 18, 19, 20, 21; 33/139, 140; 242/86.5, 54; 254/173; 43/11, 13

(56) References Cited

U.S. PATENT DOCUMENTS 3,581,267 A * 5/1971 Schreffler ..... 439/17
4,037,326 A * 7/1977 Booth et al. ..... 33/139
5,938,469 A * 8/1999 Ford et al. ..... 439/459
5,984,687 A * 11/1999 Schwartz ..... 439/17
6,036,499 A 3/2000 Ford ..... 439/4

* cited by examiner

*Primary Examiner*—P. Austin Bradley
*Assistant Examiner*—Alexander Gilman
(74) *Attorney, Agent, or Firm*—Olson & Hierl, Ltd.

(57) ABSTRACT

A coupling system suitable for use with a transmission cable is described. The system includes a rotary electrical coupling operably connected to a cable reel assembly having a main body and a reel rotatably mounted to the main body for winding the transmission cable. The rotary electrical coupling provides for the transmission of electrical signals and power between the cable on the reel and a vessel. The rotary electrical coupling includes a rolling electrical contact bearing.

19 Claims, 4 Drawing Sheets

DOWNRIGGER CABLE REEL WITH ROTARY ELECTRICAL COUPLING

FIELD OF THE INVENTION

The present invention relates generally to downrigger cable reels, and more particularly to a rotary electrical coupling for a downrigger cable reel for transmission of electrical signals and power between a vessel and a downrigger cable.

BACKGROUND OF THE INVENTION

A downrigger is a fishing implement used in conjunction with a fishing rod for deep water fishing on the Great Lakes and the oceans. A conventional downrigger has a line wound on a manually or electrically operated reel. A heavy weight is disposed at the end of the downrigger line which extends from the reel. A fishing line having a fish hook with bait or a lure affixed to it is detachably fastened to the downrigger line near the lower end thereof.

Both the downrigger line and the fishing line are lowered into the water to a desired depth. When a fish is hooked, the fishing line separates from the downrigger line as a consequence of the fish pulling on the fish hook. The fishing line pulls out of a line release device which is attached to the downrigger line. The fisherman may then play the fish without having the downrigger weight to contend with along with the fish.

As is well known, many species of fish prefer a limited range of cool water temperatures. The preferred temperature range can occur at great depth in the Great Lakes or oceans. Consequently, when fishing at such depths, the fisherman cannot see fish approach and strike the lure.

When fishing, it is desirable to be able to view the fish in the vicinity of the lure. Besides adding excitement to the fishing experience, viewing the fish provides a record in case the fish escapes. One way to view the fish at depth is to provide a camera device on a downrigger line that also serves as a cable suitable for transmitting real-time images of the lure and vicinity. One such system is described in commonly owned U.S. Pat. No. 6,036,499 to Ford.

In such an arrangement, the cable must be of a relatively small diameter to fit on a compact trolling reel and not to cause excess drag in the water. Further, the tensile strength must be relatively high since significant tension forces are placed on the line when payed out a significant distance with a heavy weight attached. The tension forces can be especially great if the cable becomes snagged.

It is also desirable to provide an electrical coupling scheme to provide power and receipt of image signals from the camera while the depth of the camera is changed by winding or unspooling the line from the reel.

The present invention provides a system which satisfies the above-discussed criteria while providing electrical continuity between the camera and the vessel.

SUMMARY OF THE INVENTION

The present invention provides a coupling system for a cable used to power and tow an electrical signal transmission device and convey the electrical signals therefrom.

The structure embodying the present invention is especially suitable for use with deep water fishing. The invention provides a plurality of electrically conductive paths between an electronic device such as an underwater camera and the boat. The connectivity of the paths is maintained while the depth of the camera is changed.

The rotational coupling system of the present invention is suitable for use with a downrigger cable, and includes a cable reel assembly having a main body and a cable reel rotatably mounted to the main body for winding the downrigger cable. A rotary electrical coupling is operably connected to the main body and to the cable reel for transmission of an electrical signal therebetween as the downrigger cable is wound onto the cable reel. The rotary electrical coupling comprises a rolling electrical contact bearing which can include contact elements such as balls, rollers, needles and the like. The rotary electrical coupling can be utilized in conjunction with an underwater camera, underwater temperature sensors, sonar, and the like devices.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENT

A rotary electrical coupling system in accordance with the present invention includes a main body having a drive mechanism and cable reel rotationally mounted to the main body and driven by the drive mechanism. Electrical pathways are provided from the vessel through the main body and cable reel to the downrigger cable by rolling electrical contact bearings. Accordingly, transmission of electrical signals and power between the cable and the vessel is maintained continuously as the downrigger cable reel rotates to play out or reel in the downrigger cable.

Figure 1:
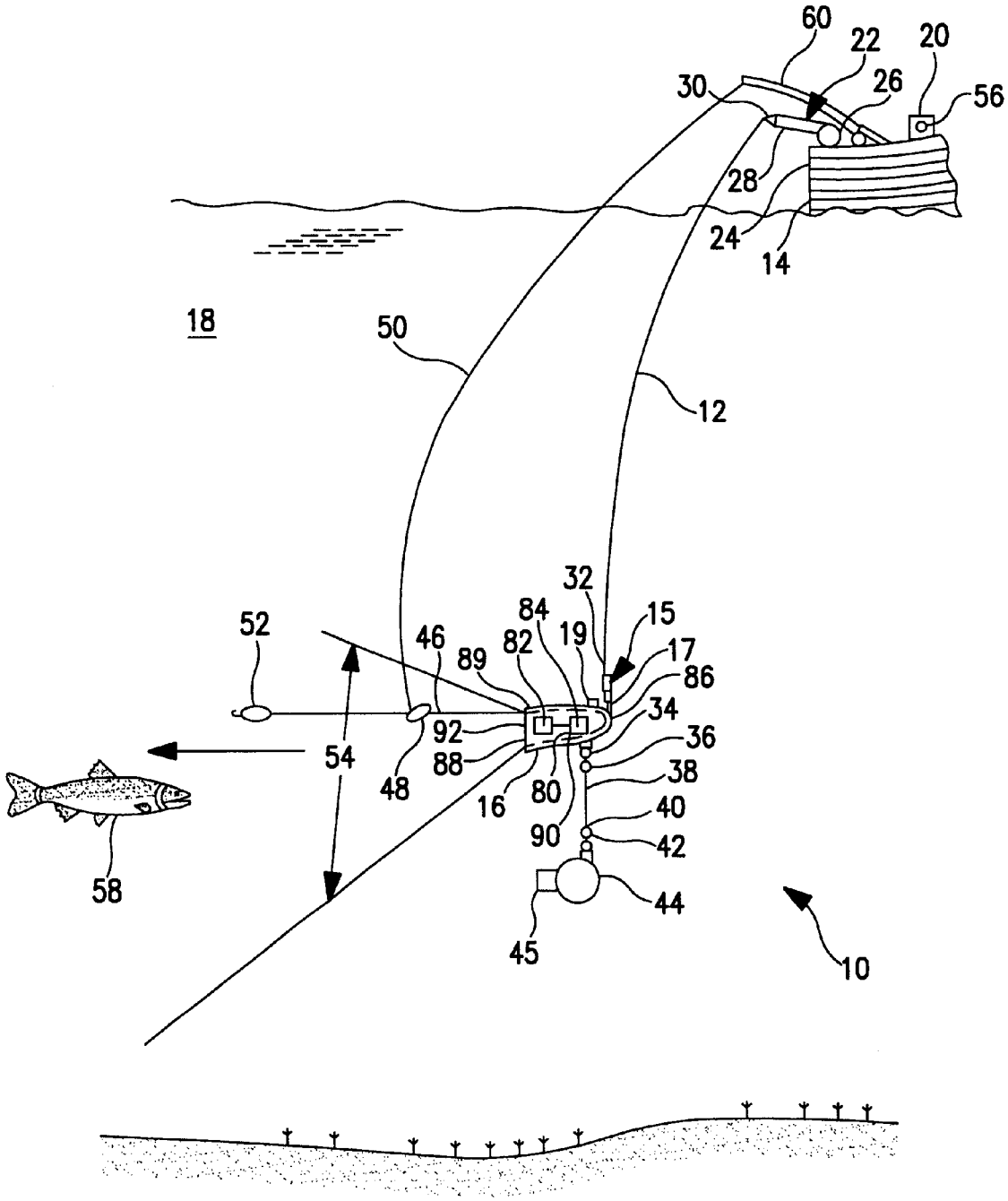
FIG. 1 is a schematic elevational view of a body of water and illustrating the operation of an underwater viewing system with a coupling system in accordance with the present invention maintaining electrical continuity between a cable attached to a motorized reel assembly and a vessel.

Referring to the drawings, and particularly to FIG. 1, an underwater viewing system 10 is depicted having a cable 12 extending from a fishing boat 14 and terminating at a connector 15 beneath the surface of the water 18. The connector 15 is attached to a camera assembly 16 that provides for transmitting images of objects in the vicinity of lure 52.

Accordingly, the cable 12 provides for real-time transmission of image signals from the camera assembly 16 to the boat 14. Operably connected to the cable 12 is a display 20 on the boat 14 for visually presenting those images introduced within the camera assembly's field of view.

The connector 15 provides a conventional snap swivel 17 for coupling the connector to the camera 16. The connector 15 also includes a plug 19 for electrically coupling the cable 12 to the camera 16.

The cable 12 is attached to a motorized reel assembly 22 mounted on the stem 24 of the boat 14. The reel assembly 22 includes a reel 26 and a flexible action arm 28 generally sloping upwardly away from the reel with a guide wheel 30 rotatably mounted to the end thereof.

The cable 12 is attached to and wrapped around reel 26. The cable 12 extends from the reel 26, over the guide wheel 30 and the edge of the boat 14, and into the water 18. The motorized reel assembly 22 provides for electrically raising and lowering the cable 12 having the underwater camera assembly 16 attached proximate to the cable's free end 32.

Coupled to the camera assembly 16, via a conventional ball bearing swivel 34, is one end 36 of a safety breakaway cable 38. The other end 40 of the safety cable 38 is fastened to a snap swivel 42 that provides for releasible attachment to a relatively heavy metal weight or ballast 44.

The weight 44 may vary from, for example, one pound to thirty pounds. The particular weight a fisherman will use depends upon the type of fishing which he is doing, the depth at which he is fishing, whether or not he is trolling or standing still, the presence of currents in the water in which he is fishing, and the like.

The weight or ballast 44 is conventional in shape and also preferably provides for stability, such as preventing porpoising of the camera assembly 16, while traveling through the water 18. Correspondingly, the weight 44 may be shaped generally like a fish, a ball having a vertical stabilizer or fin 45, or any other suitable shape.

Preferably, the cable 12 has a greater tensile strength than the safety breakaway cable 38. Thus, if the weight 44 becomes snagged during trolling, the safety cable 38 will sever so that the cable 12 and reel assembly 22 are prevented from being damaged. The breakaway cable 38 consists of any suitable material such as nylon, steel, or the like.

Extending from the camera assembly 16 is a cord 46 with a conventional line release mechanism 48 attached to the free end of the cord. Mechanism 48 releasably holds onto fishing line 50 having a fishhook or lure 52 tied to the fishing line's free end. Preferably, while line 50 is attached to the release mechanism 48, the lure 52 is continuously in the viewing range 54 of the camera assembly 16 such that a substantially representative image 56 of the lure is provided on display 20.

When a fish 58 strikes the lure 52, the efforts of the fish to free itself results in fishing line 50 being released by mechanism 48. Thus, the fisherman is permitted to play the fish in the usual fashion by means of a fishing rod 60 to which the fishing line 50 is secured.

FIG. 1 also illustrates an advantage of using the underwater viewing system 10 because the fisherman can actively view an image 56 of the fish on the display 20 as the fish approaches and strikes the lure 52. Thus, the fisherman is alerted before the fish strikes the lure and is shown the size and type of fish as well.

Camera assembly 16 preferably includes a housing 80 with a camera 82 and lower electronics unit 84 mounted therein. The housing 80 is generally parabolic in cross-sectional shape with a blunted front end 86 and an opposite open rear end 88. The desired shape of the housing 80 results in the housing rear end 88 being substantially directed at the lure 52 as the housing travels through the water 18 during trolling. The housing 80 may be constructed of any suitable material such as plastic, metal, or a metal alloy.

To further aid in the stability of the housing 80, release cord 46 is attached to the top 89 of the housing proximate to the rear end 88. As such, during trolling, the water resistance on the fishing line 50, the lure 52, and the release 48 acts as a rudder to aid in pointing the housing rear end 88 generally towards the lure 52. In addition, to dampen yaw and the like, fins (not shown) may be added to the outside of the housing 80.

As indicated above, the housing 80 provides an open cavity 90 in communication with the housing rear end 88. Enclosing the housing rear end 88 and forming a watertight seal with the housing 80 is an optically transparent cap 92. The seal is preferably waterproof to a depth of four hundred feet (400') or greater to prevent water from entering the housing cavity 90 and damaging the camera 82 mounted therein.

Camera 82 is mounted in the housing cavity 90 adjacent to the housing end cap 92. The lens of the camera 82 is pointed generally towards the fishing lure 52 such that the lure is in the field of view 54 and focus of the camera. Thus, camera 82 provides composite video signals representative of the images introduced within the camera's field of view 54.

The camera 82 desirably is a relatively low light level type. For example, tests results with a ProVideo camera Model No. CVC-50BC with a resolution of 512(H)×492(V) picture elements, EIA standard 525 TV lines (60 fields per second), and a sensitivity of 0.1 lux (F:1.6). (CSI/SPECO, Lindenhurst, N.Y.). Preferably, the camera 82 has a focus range of approximately three (3) to twenty (20) feet and is powered by a twelve (12) volt power supply at less than about 1.2 watts.

The camera 82 is operably connected to the lower electronics unit 84 within the housing cavity 90. Furthermore, the lower electronics unit 84 is operably connected to conductive leads 62, 64, and 66 and possibly one or more of the outer conductive strands 76 of cable 12. A single conductive strand can be also used in conjunction with a multiplexer in which case a single contact bearing on each side is required. The outer strands 72 are secured to the housing 80 to pull the housing through the water during trolling.

Figure 2:
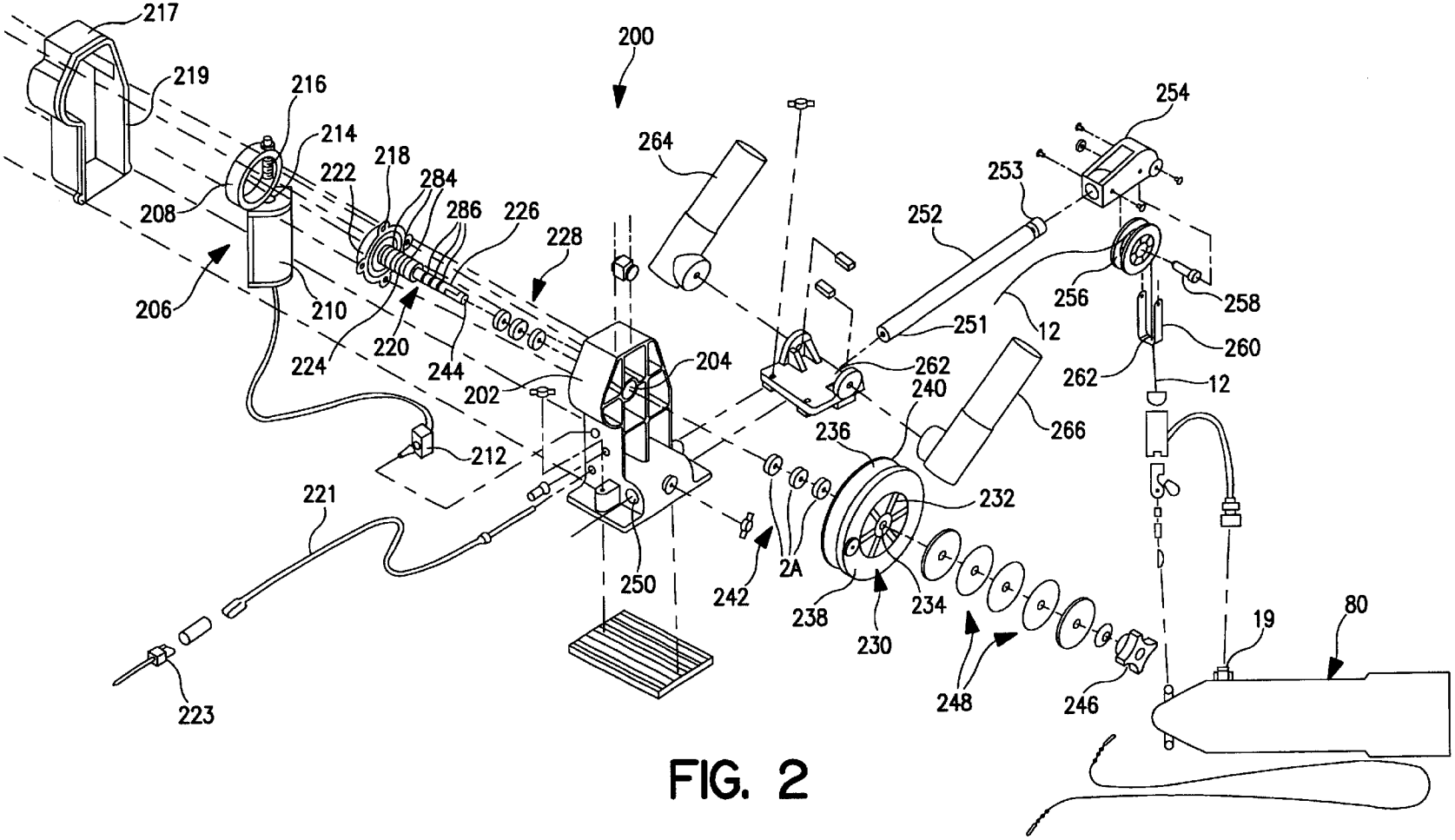
FIG. 2 is an exploded view of a cable reel assembly in accordance with the present invention.

Referring to FIG. 2, there is shown an exploded view of a downrigger cable reel assembly 200, corresponding to reel 26 of FIG. 1. Cable reel assembly 200 includes a rotary electrical coupling for transmitting electrical power and signals between the fishing boat or vessel 14 and the downrigger cable 12. Cable reel assembly 200 has a main body 202 defining a main bore 204 therethrough having a generally horizontal axis. A drive unit 206 is secured to one side of main body 202. Drive unit 206 includes a frame 208 to which is mounted an electric motor 210, and an associated on-off switch 212. Electric motor 210 has a vertically oriented shaft 214 to which a worm gear 216 is affixed. Shaft 214 and worm gear 216 extend upwardly from electric motor 210 within frame 208. A cover 217 is secured to main body 202 with a seal 219 therebetween to enclose and protect drive unit 206 from exposure to water.

An electrical cable 221 with electrical connector 223 is connected to main body 202 to provide power from the fishing boat 14 (FIG. 1) to drive unit 206 and via downrigger cable 12 to an underwater video camera, described further below. Electrical cable 221 and connector 223 also carry video signals from the underwater video camera via the downrigger cable 12 to the fishing boat 14 for connection to a video display apparatus.

Disposed between drive unit 206 and main body 202 is a bearing support 218 through which a horizontally oriented drive shaft 220 is journalled. Affixed to one end of drive shaft 220, on the side of bearing support 218 toward drive unit 206, is a gear 222 that is disposed in driven engagement with worm gear 216. Drive shaft 220 has a body portion 224 adjacent bearing support 218 and a reel portion 226 away from bearing support 218. Reel portion 226 is of somewhat smaller diameter than body portion 224.

Within main bore 204 of main body 202 are mounted rolling electrical contact bearings 228. Three such rolling contact bearings are shown. With a single conductive strand and multiplexer arrangement, only a single rolling contact bearing is required, however. Body portion 224 of drive shaft 220 is received through bearings 228 and supported thereby within main bore 204, for rotation therein. With drive shaft 220 so disposed, reel portion 226 of drive shaft 220 extends axially beyond main bore 204 of main body 202 away from drive unit 206.

A cable reel 230 has a hub 232 having an axial bore 234 therethrough, and a pair of spaced flanges 236 and 238 extending radially therefrom to define an annular groove 240 in which downrigger cable 12 is wound about cable reel 230. Within axial bore 234 of cable reel 230 are mounted rolling electrical contact bearings 242. Reel portion 226 of drive shaft 220 is received through bearings 242 such that cable reel 230 is supported thereon by bearings 242 for rotation about reel portion 226. Again, if a single conductive strand is utilized in conjunction with a multiplexer, only a single rolling contact bearing is needed.

Drive shaft 220 has a free end 244 that is provided with male threads for threadedly receiving a knob 246 having mating female threads therein. Knob 246 is disposed axially outwardly of cable reel 230. Disposed between cable reel 230 and threaded knob 246 are a plurality of spacer washers 248 that are pressed by knob 246 into frictional engagement with hub 232 of cable reel 230. Drive shaft 220 is thereby frictionally connected to cable reel 230 such that rotation of drive shaft 220 causes cable reel 230 to rotate therewith. Because the connection between drive shaft 220 and cable reel 230 is frictional rather than rigid, it is possible for cable reel 230 to rotate relative to reel portion 226 of drive shaft 220 if excessive tension should occur in downrigger cable 12, such as by becoming snagged. The amount of tension necessary to overcome the frictional connection between cable reel 230 and drive shaft 220 can be adjusted by turning knob 246 to increase or decrease the compression of washer spacers 248 against hub 232. The connection between cable reel 230 and drive shaft 220 is in the nature of a slip clutch.

Main body 202 includes a substantially horizontal mounting bore 250 oriented perpendicular to the axis of the drive shaft 220, located below and generally coplanar with cable reel 230. Received within mounting bore 250 is a first end 251 of a rod 252 that extends away from main body 202. Mounted to the second end 253 of rod 252 is a bracket 254. A pulley wheel 256 is mounted to bracket 254 by pivot pin 258. A U-shaped cable guide 260 is pivotally attached to bracket 254 and has an aperture 262 through the base of the U through which downrigger cable 12 is reeved after passing from cable reel 230 and over pulley wheel 256.

Another bracket 262 is attached to main body 202 and supports a pair of fishing rod support tubes 264 and 266 in which the handle grip portion of a fishing rod can be conveniently received for the purpose of holding the fishing rod when it is not being actively used to play a hooked fish. Bracket 262 and tubes 264 and 266 need not necessarily be associated with and attached to main body 202, but could be separately mounted to the fishing boat or vessel 14 in the vicinity of main body 202.

Figure 3:
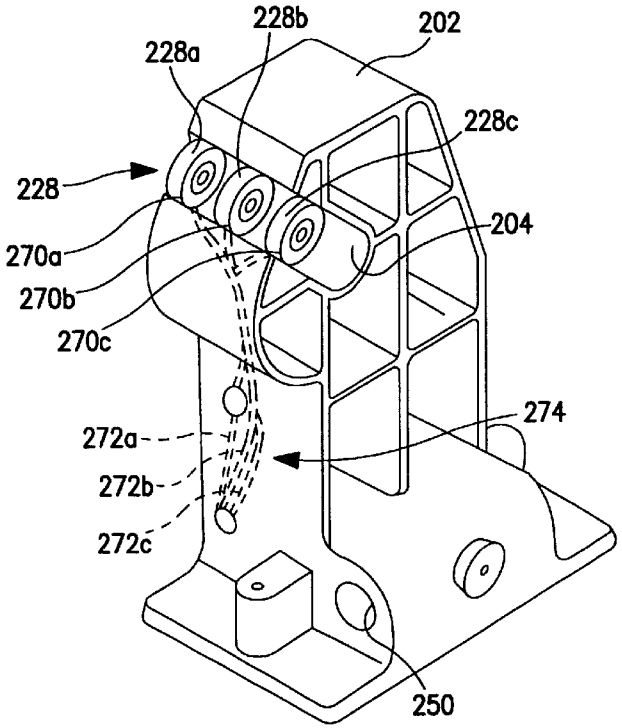
FIG. 3 is an enlarged, partially cut-away view of the main body of the cable reel assembly of FIG. 2, revealing rolling electrical contact bearings mounted within a main bore.

Referring to FIG. 3, there is shown an enlarged view of the main body 202 of FIG. 2, with a portion cut away to reveal the first plurality of rolling electrical contact bearings 228 disposed within main bore 204. The plurality of bearings 228 is comprised of three spaced individual bearings 228*a*, 228*b* and 228*c*, each having an outer ring that is stationary relative to main bore 204. Electrical contact regions 270*a*, 270*b* and 270*c* are disposed on the inner wall of main bore 204 in electrical contact with the outer rings of bearings 228*a*, 228*b* and 228*c*, respectively. Electrical contact regions 270*a*, 270*b* and 270*c* are connected via three separately insulated conductors 272*a*, 272*b* and 272*c*, respectively, to cable 221.

Figure 4:
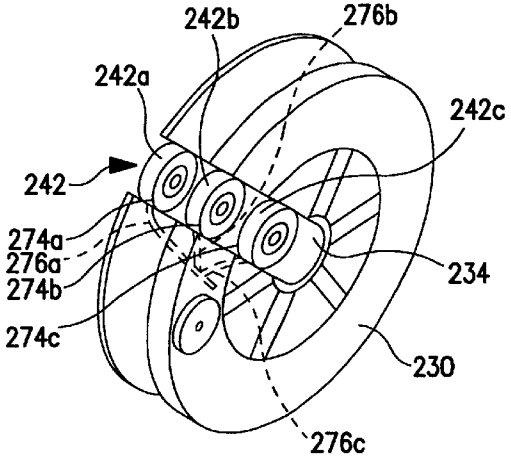
FIG. 4 is an enlarged, partially cut-away view of the cable reel of the cable reel assembly of FIG. 2, revealing rolling electrical contact bearings mounted within an axial bore.

FIG. 4 is an enlarged view of cable reel 230 of FIG. 2, with a portion cut away to reveal the second plurality of rolling electrical contact bearings 242 disposed within bore 234. The plurality of bearings 242 is comprised of three spaced individual bearings 242*a*, 242*b* and 242*c*, each having an outer ring that is stationary relative to bore 234. Electrical contact regions 274*a*, 274*b* and 274*c* are disposed on the inner wall of main bore 234 in electrical contact with the outer rings of bearings 242*a*, 242*b* and 242*c*, respectively. Electrical contact regions 274*a*, 274*b* and 274*c* are connected via three separately insulated conductors 276*a*, 276*b* and 276*c*, respectively, to downrigger cable 12 which is wound around cable reel 230.

Figure 5:
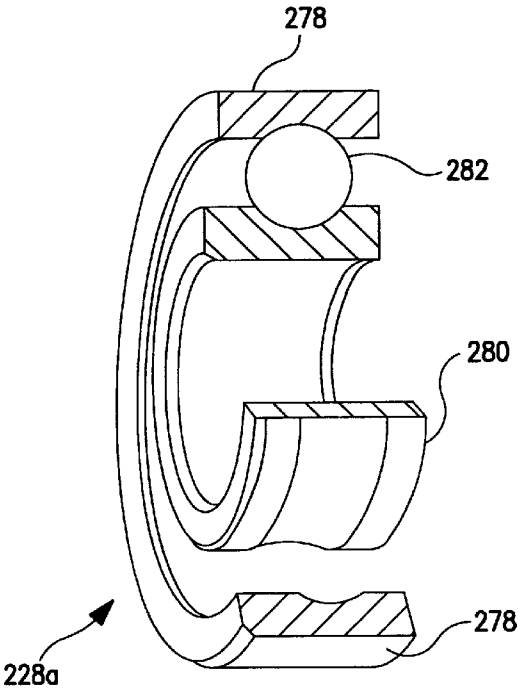
FIG. 5 is an enlarged, partially cut-away view of a rolling electrical contact bearing of FIG. 2.

FIG. 5 is an enlarged view of rolling electrical contact bearing 228*a*, partially cut away. The other electrical contact bearings 228*b* and 228*c* are substantially similar. Electrical contact bearings 274*a*, 274*b* and 274*c* are likewise similar to bearing 228*a*, except that they are smaller in diameter. Rolling electrical contact bearing 228*a* is comprised of an outer ring or race 278, an inner ring or race 280 disposed concentrically within outer race 278, and a plurality of rolling contact elements 282 (only one of which is shown), such as balls, rollers, needles, and the like, disposed in the annular space defined between outer race 278 and inner race 280. Contact elements 282, which are in rolling contact with outer race 278 and inner race 280, permit outer race 278 to rotate relative to inner race 280 while remaining annularly spaced therefrom. Outer race 278, inner race 280 and contact elements 282 are all electrically conductive, such that inner race 278 is operably electrically connected with electrical contact 270*a* (see FIG. 3) through inner race 280, contact elements 282 and outer race 278.

Figure 6:
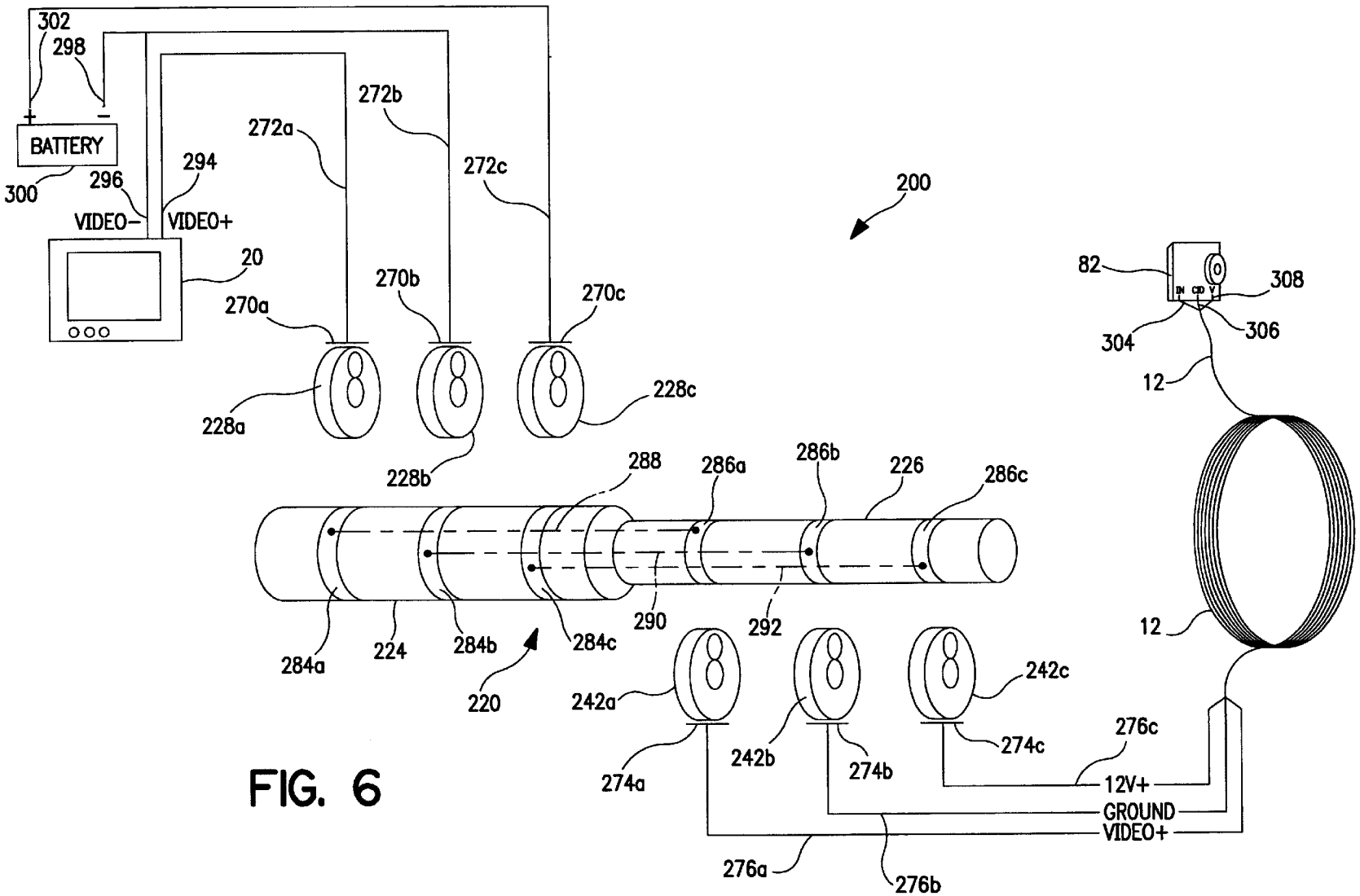
FIG. 6 is a schematic diagram of the electrical pathways between the camera attached to the downrigger cable and the display and power source mounted on the vessel.

FIG. 6 shows schematically the rotary electrical coupling of downrigger cable reel assembly 200. When operatively assembled, body portion 224 of drive shaft 220 is received through the aligned bores of the inner races of the three rotary electrical contact bearings 228 comprising bearings 228*a*, 228*b* and 228*c*. Disposed about the circumference of and fixed to body portion 224 of drive shaft 220 are a plurality, preferably three in number, of annular conductive rings 284, comprising ring 284*a*, ring 284*b* and ring 284*c*, each of which is electrically insulated from the others and in electrical contact with the inner race of a corresponding one of rotary electrical contact bearings 228*a*, 228*b* and 228*c*. Furthermore, when operatively assembled, reel portion 226 of drive shaft 220 is received through the aligned bores of the inner races of the three rotary electrical contact bearings 242 comprising bearings 242*a*, 242*b* and 242*c*. Disposed about the circumference of and fixed to reel portion 226 of drive shaft 220 are a plurality, preferably three in number, of annular conductive rings 286, comprising ring 286*a*, ring 286*b* and ring 286*c*, each of which is electrically insulated from the others and in electrical contact with the inner race of a corresponding one of rotary electrical contact bearings 242*a*, 242*b* and 242*c*.

Annular conductive ring 284*a*, such as a slip ring of body portion 224, is electrically connected to annular conductive ring 286*a*, such as a slip ring of relatively smaller diameter, of reel portion 226 by electrical conductor 288. Similarly, annular conductive ring 284*b* of body portion 224 is electrically connected to annular conductive ring 286*b* of reel portion 226 by electrical conductor 290. Likewise, annular conductive ring 284*c* of body portion 224 is electrically connected to annular conductive ring 286*c* of reel portion 226 by electrical conductor 292.

Electrical contact regions 270*a*, 270*b* and 270*c* and respective conductors 272*a*, 272*b* and 272*c* (see also FIG. 3) connect electrically the outer races of rotary electrical contact bearings 228*a*, 228*b* and 228*c* to, respectively, the positive video input 294 of display 20, the common video input 296 of display 20 and the negative terminal 298 of 12-volt storage battery 300, and the positive terminal 302 of battery 300. Alternatively, once the video signal is received at the downrigger, further transmission of the received signal to the monitor can be effected by wireless transmission.

Electrical contact regions 274*a*, 274*b* and 274*c* and respective conductors 276*a*, 276*b* and 276*c* and cable 12 (see also FIG. 4) connect the outer races of rotary electrical contact bearings 242*a*, 242*b* and 242*c* to, respectively, the positive video output 304 of camera 82, the common terminal 306 of camera 82, and the positive power terminal 308 of camera 82.

As a consequence of the electrical connections described above, cable reel assembly 200 provides a reliable uninterrupted electrical path between positive terminal 302 of battery 300 and the positive power terminal 308 of camera 82. Likewise, an uninterrupted electrical path is provided between negative terminal 298 of battery 300 and common video input 296 of display 20 and the common terminal 306 of camera 82. Similarly, an uninterrupted electrical path is provided between positive video input 294 of display 20 and the positive video output 306 of camera 82. As drive shaft 220 rotates relative to main body 202, electrical pathways are maintained continuously through rolling electrical contact bearings 228. Furthermore, should cable reel 230 rotate relative to drive shaft 220 due to frictional slippage, electrical pathways are maintained continuously through rolling electrical contact bearings 242.

It will be readily apparent from the foregoing detailed description of the invention and from the illustrations thereof that numerous variations and modifications may be effected without departing from the true spirit and scope of the novel concepts or principles of this invention.

I claim:

1. A coupling system suitable for use with a downrigger cable comprising:

a cable reel assembly having a main body and a cable reel rotatably mounted on a drive shaft to said main body for winding said downrigger cable, said main body and said cable reel defining a main bore and an axial bore respectively; and a rotary electrical coupling operably connected to said main body and to said cable reel for transmission of an electrical signal therebetween, said rotary electrical coupling comprising a rolling electrical contact bearing in one of said main bore or said axial bore and surrounding said drive shaft for maintaining an electrical connection between the main body and the reel during relative motion therebetween.

2. The coupling system of claim 1, wherein said drive shaft has an annular conductive ring in electrical contact with the electrical contact bearing.

3. The coupling system of claim 2, wherein the rolling electrical contact bearing includes an inner race in electrical contact with the annular conductive ring of the drive shaft.

4. The coupling system of claim 3, wherein the rolling electrical contact bearing includes an outer race in electrical contact with the downrigger cable.

5. The coupling system of claim 4, wherein the downrigger cable is operably coupled to a camera assembly.

6. A coupling system suitable for use with a downrigger cable comprising:

a cable reel assembly having a main body and a cable reel rotatably mounted on a drive shaft to said main body for winding said downrigger cable, said main body and said cable reel defining a main bore and an axial bore respectively for said drive shaft; and a rotary electrical coupling operably connected to said main body and to said cable reel for transmission of an electrical signal therebetween, said rotary electrical coupling comprising a plurality of rolling electrical contact bearings in said main bore or said axial bore and surrounding said drive shaft and electrically isolated from one another.

7. The coupling system of claim 6, wherein said rotary electrical coupling includes a drive shaft rotatably mounted to said main body and having a plurality of annular conductive rings electrically isolated from one another.

8. The coupling system of claim 7, wherein the cable reel is attached to the drive shaft.

9. The coupling system of claim 7, wherein each of the rolling electrical contact bearings includes an inner race in electrical contact with a respective one of the annular conductive rings of the drive shaft.

10. The coupling system of claim 9, wherein each of the rolling electrical contact bearings includes an outer race in electrical contact with the downrigger cable.

11. The coupling system of claim 10, wherein the downrigger cable is operably coupled to a camera assembly.

12. A coupling system suitable for use with a downrigger cable comprising:

a cable reel assembly having a main body and a cable reel rotatably mounted to said main body for winding said downrigger cable, said main body and said cable reel defining a main bore and an axial bore respectively; and a rotary electrical coupling operably connected to said main body and to said cable reel for transmission of an electrical signal therebetween, said rotary electrical coupling including a drive shaft rotatably mounted to and extending through said main body and said cable reel, and further including a first rolling electrical contact bearing located in said main bore and supporting said drive shaft in said main body and a second rolling electrical contact bearing located in said axial bore and supporting said cable reel on said drive shaft.

13. The coupling system of claim 12, wherein said drive shaft includes a first annular conductive ring in electrical contact with the first electrical contact bearing in said main bore and a second annular conductive ring in electrical contact with the second electrical contact bearing in said axial bore.

14. The coupling system of claim 13, wherein each rolling electrical contact bearing includes an inner race in electrical contact with a respective annular conductive ring of the drive shaft.

15. The coupling system of claim 14, wherein the second rolling electrical contact bearing includes an outer race in electrical contact with the downrigger cable.

16. The coupling system of claim 15, wherein the downrigger cable is operably coupled to a camera assembly.

17. The coupling system of claim 13, wherein the first and second annular conductive rings are electrically connected to each other by an electrical conductor extending through the drive shaft between said first and second annular conductive rings.

18. The coupling system of claim 17 further comprising a plurality of spaced-apart rolling electrical contact bearings in said main bore and a plurality of spaced-apart second rolling electrical contact bearings in said axial bore respectively electrically connected to each other by a plurality of electrical conductors extending therebetween through said drive shaft.

19. The coupling system of claim 18 wherein said plurality of first spaced-apart rolling electrical contact bearings are adapted to be electrically connected to the input of a video and the terminal of a battery and said plurality of second spaced-apart rolling electrical contact bearings are adapted to be electrically connected to the output and the terminal of a camera.

* * * * *